US007375606B2

(12) United States Patent
Talon et al.

(10) Patent No.: US 7,375,606 B2
(45) Date of Patent: May 20, 2008

(54) ELECTROMAGNETIC CONTRACTOR FOR CONTROLLING AN ELECTRIC STARTER

(75) Inventors: Frédéric Talon, Solaize (FR); Pierre Magnier, Lyons (FR); Christophe Gruet, Lyons (FR)

(73) Assignee: Valeo Equipements Electriques Moteur, Creteil (FR)

( * ) Notice: Subject to any disclaimer, the term of this patent is extended or adjusted under 35 U.S.C. 154(b) by 0 days.

(21) Appl. No.: 10/551,064

(22) PCT Filed: Mar. 26, 2004

(86) PCT No.: PCT/FR2004/000764

§ 371 (c)(1),
(2), (4) Date: Jul. 5, 2006

(87) PCT Pub. No.: WO2004/088126

PCT Pub. Date: Oct. 14, 2004

(65) Prior Publication Data

US 2007/0171583 A1 Jul. 26, 2007

(30) Foreign Application Priority Data

Mar. 28, 2003 (FR) ..... 03 03876

(51) Int. Cl.
*H01F 67/02* (2006.01)

(52) U.S. Cl. ..... 335/202; 335/126; 335/131; 335/278; 335/281

(58) Field of Classification Search ..... 335/126, 335/131, 132, 202, 278, 281
See application file for complete search history.

(56) References Cited

U.S. PATENT DOCUMENTS

| | | | |
|---|---|---|---|
| 4,755,781 | A | 7/1988 | Boegner |
| 2002/0067231 | A1 | 6/2002 | Kurasawa et al. |
| 2002/0145494 | A1 | 10/2002 | Andoh et al. |

FOREIGN PATENT DOCUMENTS

| | | | |
|---|---|---|---|
| DE | 195 42 142 | A1 | 5/1997 |
| FR | 2796991 | A1 | 2/2001 |

OTHER PUBLICATIONS

English Abstract of Patent No. FR2796991 (1 page).
English Abstract of Patent No. DE19542142 (1 page).

*Primary Examiner*—Ramon M Barrera
(74) *Attorney, Agent, or Firm*—Osha Liang LLP

(57) ABSTRACT

The metal housing of the case of a contactor includes an annular rib extending continuously opposite the cylindrical periphery of the main stationary core, the rib having an internal diameter respectively greater than that of the ferrule and smaller than that of the housing, so as to ensure the locking of the different parts of the case and the crimping of the housing on the stationary magnet following local deformations exerted on the reduced diameter of the swaged part defining the rib.

18 Claims, 3 Drawing Sheets

ELECTROMAGNETIC CONTRACTOR FOR CONTROLLING AN ELECTRIC STARTER

BACKGROUND OF THE INVENTION

1. Field of the Invention

The invention relates to an electromagnetic contactor for an electric starter motor, said contactor comprising:

connection terminals intended for connection to the battery and to the electric motor, a movable core, a main stationary core, an axial air gap provided between the movable core and the main stationary core, a tubular coil to produce a magnetic current in the air gap provided between the movable core and a main stationary core during excitation, a magnetic circuit provided with a case constructed with magnetic frame attached to the stationary core, an insulating cap enclosing the contacts of the electric power circuit and having connection terminals, said case being composed of a metal bell-shaped housing, an internal ferrule made of magnetic material surrounding the coil, and a washer acting as an additional stationary core through which the movable core passes, and arranged opposite the main stationary core.

2. Background Art

Starters generally comprise an electromagnetic contactor, the purpose of which is to make it possible for:

the pinion to engage in the drive ring gear at the moment of starting, as well as its disengaging after starting, and the electric motor to be supplied with current.

The contactor is generally composed of an electromagnet actuating a plunger core which, by moving, closes an electrical circuit for supplying power to the electric motor, and pulls an actuator lever that drives the pinion into the starter ring gear.

According to the document FR-A-2795884, a motor vehicle starter (see FIG. 5) has a rotary electric motor M and an output shaft equipped with a pinion 1 to drive a starter ring gear C, integral in rotation with the flywheel of the vehicle to start the combustion engine of the vehicle. The pinion 1 is slidably mounted, by means of complementary splines, on the output shaft between a rest position in which it is disengaged from the ring gear, and an active working position in which it engages with said ring gear.

The output shaft is driven in rotation by the electric motor when said motor is electrically powered. This shaft is different from the shaft of the motor M in FIG. 6 because speed-reduction gearing is located between the two shafts. As a variation, the output shaft is the shaft of the motor M.

The electric motor of the starter is also associated with an electromagnet power contactor 2 placed above the electric motor. This contactor 2 comprises a tubular coil 2*a* held by a support, the bottom of which constitutes a bearing 2*c* to guide a movable core 2*b*.

This contactor 2 has the dual function of supplying the electric motor M with current, and of moving the movable pinion 1 between the two positions of rest and work. The excitation of the electromagnet is controlled, for example, by activating the contact key, which establishes the electrical circuit to the battery, after the closing of the contactor's main power circuit.

The movable core 2*b* of the contactor 2 is mechanically connected by a mechanical connection 4, comprising a control lever, to a starter drive assembly equipped with a freewheel transmission device. The pinion 1 pertains to the starter drive assembly.

The fork-shaped control lever is pivotably mounted on a spindle and the output shaft is mounted in rotation in a housing by means of bearings.

The housing is intended to be attached to a fixed part of the vehicle and is open for the passage of the ring gear C. This housing is thus used to attach the starter to the engine of the vehicle.

The main power circuit of the contactor is provided with a pair of fixed contacts, and a bridge-shaped movable contact 3 which is attached to a pushrod actuator intended to be moved in translation by the movable core during excitation of the coil.

More specifically, the pushrod is intended to be moved by the movable core 2*b* after the axial clearance is closed up, and a second return spring acts on the movable core to draw it back to the rest position.

A first return spring, called cutoff spring, pulls the movable contact and pushrod assembly to an open position in order to make an axial interval with the fixed contacts.

This rest position of the pushrod is determined by contact of the movable contact 3 with a stationary core having a central hole to guide the pushrod provided with a flange for mounting a spring, called contact pressure spring, acting between this flange and the movable contact. The stationary core is flanged and has a centering seat for centering the support of the coil 2*a*.

Also provided is a spring 5, called gear engagement spring, housed inside the movable core 2*b* and engaged with a rod connected by a spindle to the upper end of the fork-shaped control lever to couple this lever to the movable core 2*b*.

The contactor, generally cylindrical in shape, is situated near the electric motor while extending parallel thereto. It is attached to the above-mentioned housing that supports the output shaft and the pinion slidably mounted on said shaft. In a known way the housing also has the frame of the electric motor M closed by a rear bearing for the mounting in rotation of the shaft of the electric motor M. The housing has a front bearing for the mounting in rotation of the output shaft as an extension of the shaft of the electric motor M by means of a bearing between the ends of the said shafts.

In addition to the movable core, the contactor comprises a fixed part of magnetic material, and a cap of insulating material and having connection terminals connected to the fixed contacts. The fixed part of the contactor is composed of a dish-shaped frame designed to be mounted on the housing, and the stationary core separated from the movable core by an axial air gap. The tubular coil coaxially surrounds the movable core with a slight radial clearance, and is housed inside the case.

The movable core, under the action of the second return spring, is in a position separated from the stationary core when the coil is not excited.

When power is supplied to the coil, i.e., during excitation of the coil, the movable core moves by magnetic attraction toward the stationary core at first against the retraction force of the first return spring. After the closing up of the axial clearance between the movable core and the pushrod, the movable core then moves the pushrod against the force exerted by the second and first return springs. This first return spring is stiffer than the second return spring and is less stiff than the contact pressure spring.

This movement continues until the movable contact makes contact with the fixed contacts and power is supplied to the electric motor. The contact pressure spring is then compressed until the movable core comes into contact with the stationary core.

At the same time the starter drive assembly is moved, under action from the control lever, toward the ring gear C.

In the event the pinion 1 does not directly penetrate the ring gear C, the spring 5 is compressed to allow the fixed contacts to close and supply power to the electric motor, which then turns the pinion so that it can penetrate the ring gear C.

The structure of the magnetic circuit of such a contactor is well known, for example from the document DE 101 55 103 or by the above-mentioned document FR A 2 795 884.

In FIG. 1, the stationary core 10 of the contactor is generally immobilized in rotation with respect to the case 11 attached by one or more deformations of the case's side wall so as to form serrations 12 that are embedded in cavities 13 made on the periphery or behind the stationary core 10. When the case is produced by stacking several elements, careless handling of the case can result in a risk of the assembly coming apart.

In FIG. 2, the cap 14 must also be blocked from rotation with respect to the case 11 in order to withstand a certain tightening torque C on the connection terminals. The serrations 12*a* provided for that purpose are also made by deformation of the material of the end of the case 11, which are then inserted into the cavities 13*a* of the cap 14. When a certain tightening torque on the cap 14 is exceeded, said cap can undergo the beginning of rotation movement, with the risk of the serrations 12*a* escaping. This situation could occur in the event of insufficient mechanical rigidity of a case obtained by stamping a thin (0.5 to 1.5 mm) sheet of metal. The risk of ovalization of the case due to the action of a heavy rotation torque is then possible, and the function of immobilizing the case from rotation is no longer ensured.

SUMMARY OF THE INVENTION

In general, in one aspect, embodiments of the invention remedy the above-mentioned disadvantages. In general, in one aspect, an embodiment of the invention relates to a starter contactor having a reinforced mechanical strength, irrespective of the tightening torque exerted on the connection terminals.

A device according to one embodiment of the invention is characterized in that the metal housing of the case comprises an annular rib extending continuously opposite the cylindrical periphery of the main stationary core, said rib having an internal diameter respectively greater than that of the ferrule and smaller than that of the housing, so as to ensure the locking of the different parts of the case.

Thus, in one embodiment, the rib provides the locking of the different parts of the case as well as the crimping of the housing on the stationary core following local deformations exerted on the reduced diameter of the swaged part defining the rib.

The presence of the rib at the end of the housing of the contactor makes it possible to ensure both a stable support of the ferrule and the washer inside the housing, as well as increasing the rigidity of the case 11, preventing any deformation due to the torque exerted on the cap when the connection terminals are tightened.

Moreover, the rib can serve as a centerer for the stationary core so that the quantity of material of said core can be reduced. With this type of arrangement, the standard type of stationary cores can be used with the case being sized accordingly. The cap is a presser cap acting on the stationary core, which acts on the ferrule.

According to one embodiment of the invention, the main stationary core is provided with radial cavities in which serrations of the housing are embedded during the crimping operation. The cap includes at least an axial stud intended to engage in a notch of the stationary core during assembly of the cap on the end of the housing.

In one embodiment of the invention, the notch that receives the stud can be the same as a cavity of the stationary core. After assembly, additional serrations are made on the end of the housing to immobilize the insulating cap from rotation.

Other aspects and advantages of the invention will be apparent from the following description and the appended claims.

BRIEF DESCRIPTION OF THE DRAWINGS

Other advantages and characteristics will be seen more clearly from the following description of one form of embodiment of the invention, given by way of non-limiting example, and represented in the appended drawings in which.

DETAILED DESCRIPTION

Exemplary embodiments of the invention will be described with reference to the accompanying figures. Like items in the figures are shown with the same reference numbers. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

Embodiments of the invention relate to an electromagnetic contactor for an electric starter motor.

Figure 3:
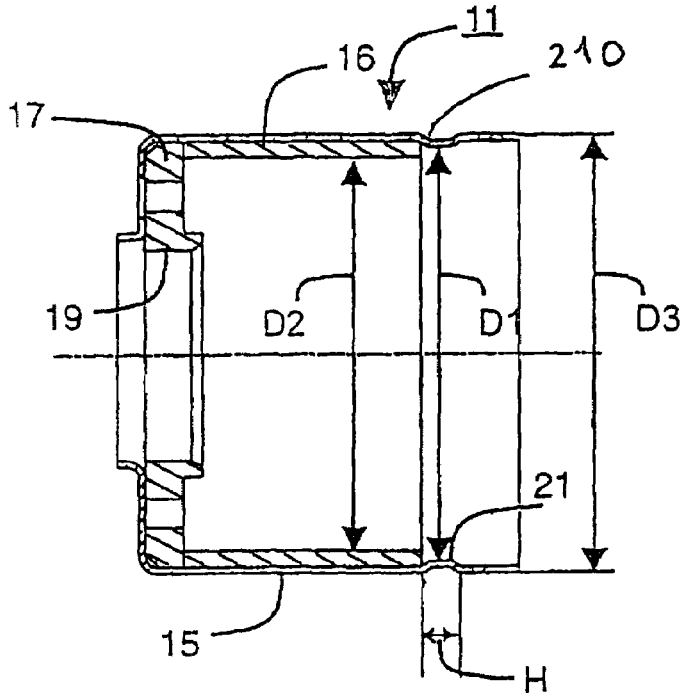
FIG. 3 shows a cross sectional view of a case of a contactor according to one embodiment of the invention.

In FIG. 3 the movable core 18 is in the rest position so that the axial air gap between the stationary core 10 and the movable core 18 is at a maximum.

Figure 4:
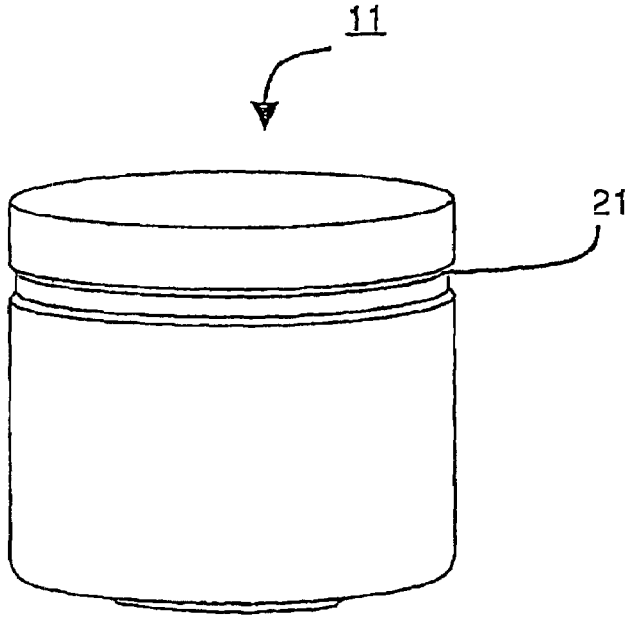
FIG. 4 is a view in perspective of the case of FIG. 3.
Figure 5:
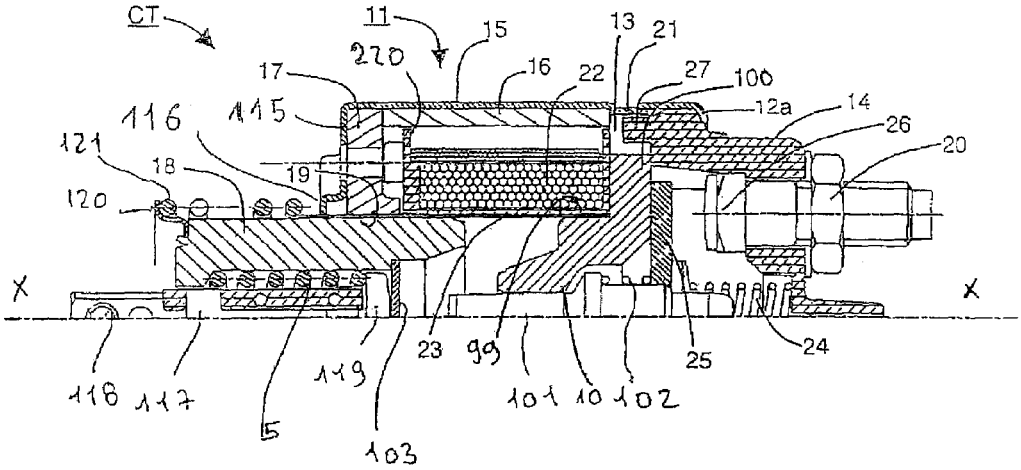
FIG. 5 illustrates a half-view in cross section of the contactor equipped with the case of FIG. 3.
Figure 6:
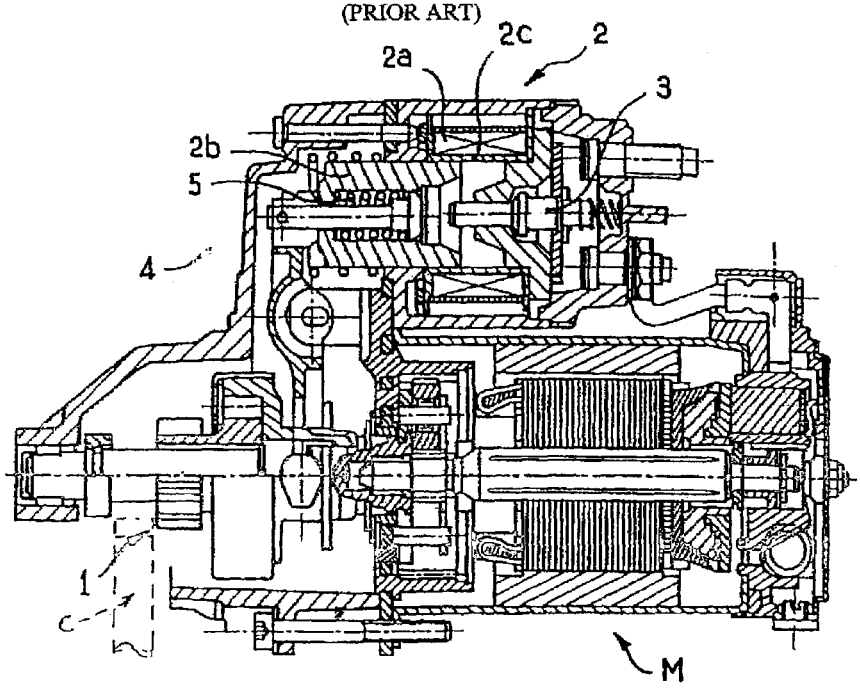
Figure 6 (PRIOR ART)
FIG. 6 is an axial cross sectional view of a starter of the prior art.

In FIGS. 3 to 5, the case 11 is formed from several elements, comprising a bell-shaped metal housing 15, an internal cylindrical ferrule 16 of mild steel, and a washer 17 of magnetic material serving as additional stationary core.

The cylindrical shaped housing 15 comprises an end plate 115 with a central hole through which the core 18 passes. This end plate is transversely oriented with respect to the X X axis of the contactor CT and is configured to form, centrally at its inner periphery, an axial protrusion 116 directed in the opposite direction of the washer 17. The protrusion 116 is annular in shape. Advantageously, this housing 15 is obtained economically by deep drawing.

The axis X X constitutes the axis of the coil 22, the movable core 18 and the pushrod 101 intended to be moved by the movable core 18 via an internal washer 103 integral with the core 18. 102 is the contact pressure spring, 24 is the first return spring, i.e., the cut-off spring, 121 is the second return spring and 5 is the gear engagement spring.

All of these springs are helicoid.

It will be noted that the washer 103 of the movable core 18 closes a cavity terminated by a centrally open end plate through which the rod 117 passes, which rod is connected by the pin 118 to the control lever (not shown). The gear engagement spring 5 is supported on this end plate and on a flanged end of the rod 18.

A pan 120 is attached, in this instance by crimping, to the movable core 18. This pan serves as support for one end of the second return spring 121.

According to one characteristic, the protrusion 116 serves as support for the other end of the spring 121 so that the housing has an additional function.

The washer 17 is pressed against the end plate 115 of the housing 15, and comprises in the central part a circular orifice 19 allowing the axial passage of the movable core 18. The central protrusion 116 of the end plate 115 also has a circular orifice allowing the axial passage of the core 18.

To provide both functions, i.e., on the one hand, providing stable support of the ferrule 16 and the washer 17 in the housing 15, and on the other hand, the rigidification of the case 11 avoiding any deformation due to the torque exerted on the cap 14 when the connection terminals 20 are tightened, the cylindrical side wall of the housing 15 undergoes a local swaging in order to form an annular rib 21 opposite the location of the stationary core 10. By way of example, the swaging is obtained by deformation of the material, resulting in a decrease of the diameter obtained by roll bending the whole outer circumference of the housing 15.

The inside diameter D1 of the rib 21 is greater than the inside diameter of the ferrule 16, and smaller than the diameter D3 of the housing 15. The thickness H of the rib 21 measured in the axial direction is less than or equal to the thickness of the stationary core 10.

Thus, it can be seen from the description and drawings that the washer 17 is first mounted in the housing 15 in contact with the end plate 115, then the ferrule is added in the housing 15, and finally the material of the housing 15 is deformed in contact with the free end of the ferrule 16 to axially block said ferrule and form the swaged part. A case 11 in three parts 15, 16, 17 is thus obtained, which comprises a subassembly that can be handled and transported. This solution does not require welding operations.

Advantageously the ferrule 16 is in close contact at its periphery with the inner periphery of the housing 15. This is also the case with the washer 17. These parts 16, 17, as well as the housing 15, are advantageously made of mild steel so that they are electrical conductors and the magnetic current can flow through these parts when power is supplied to the coil 22. The washer 17 can have the required thickness. Of course, the housing 15 can undergo a surface treatment to give it an aesthetic appearance. As a variation, the housing 15 is made of non-magnetic material such as an aluminum based material.

As a variation, the housing 15, the ferrule 16 and the washer 17 can have a cross section that is square, rectangular, polygonal or other.

The end plate 115 protects the washer 17, which thus has little susceptibility to corrosion. This is also the case with the ferrule 16. The thickness of the washer 17 is greater than that of the ferrule 16.

The coil 22 is then mounted, having an annular support 220 with U-shaped cross section.

The coil 22, via its annular support 220, and the washer 17 are mounted on a support tube 23 forming a bearing for the core 18 and being supported on an annular centering flange 99 and with axial orientation of the stationary core 10. This flange 99 is extended at one of its ends by a side plate 100 of transverse orientation with respect to the axis X X.

This end plate forms a support flange and thus an axial stop for the support 220 and for the tube 23.

The support 23 passes through the orifice 19 of the housing 15 and of the protrusion 116. A first return spring 24 pulls the movable bridge contact 25 against the stationary core 10, while making an axial interval with the stationary contacts 26, only one of which is visible in FIG. 5.

The side plate 100 in this instance is cylindrical in shape. Its outer periphery is in close contact with the inside periphery of the rib 21, which thus serves as centerer of the side plate 100 and therefore of the stationary core 10. The rib 21 therefore also makes it possible to reduce the height of the side plate 100 and thus the quantity of material of the stationary core, making it more economical.

Figure 1:
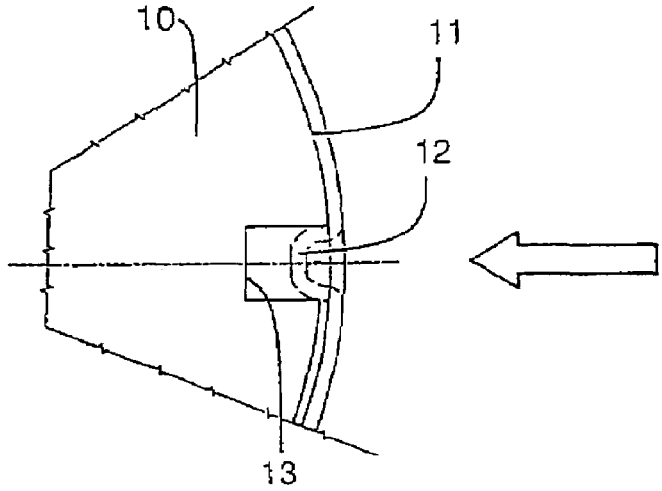
Figure 1 (PRIOR ART)
FIG. 1 is a partial view of the contactor according to the prior art, where the case is attached to the stationary core.
Figure 2:
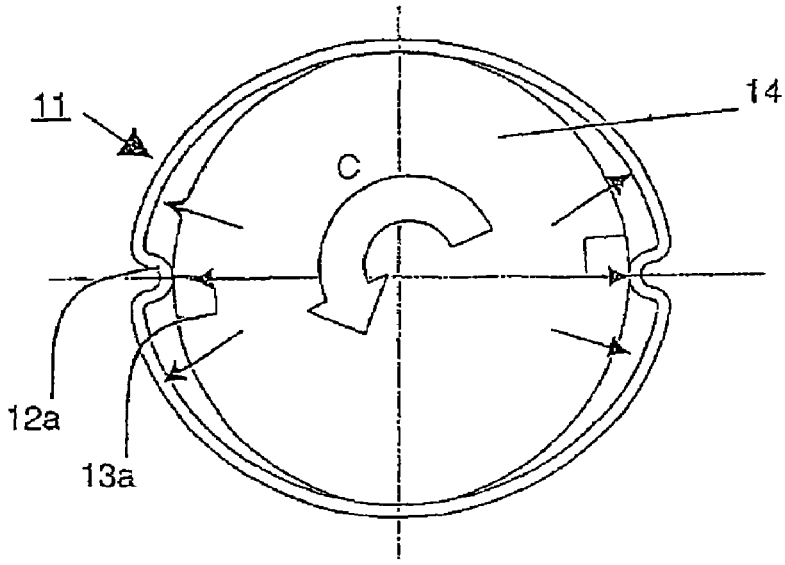
Figure 2 (PRIOR ART)
FIG. 2 shows a partial view of the contactor according to the prior art, where the case is attached to the insulating connection cap.

Advantageously the inside periphery of the rib 21, and thus of the swaged part, includes a cylindrical portion, visible in FIG. 3, which serves as centerer for the side plate 100. This portion has the above-mentioned inside diameter of D1. Two sloping sides extend on either side of this centering portion to define with said portion the rib 21. One of these sloping sides, the side 210 adjacent to the free end of the ferrule 16, makes it possible to tighten this ferrule so that it presses against the washer 17, which in turn is pressed against the end plate 115. This sloping side 210 is thus a tightening side. Of course, as a variation the groove has another shape, such as an overall V shape with rounded point and cross section similar to that of the serrations 12 of FIG. 2.

The outer periphery of the stationary core 10, i.e., the outer periphery of the side plate 100, in this instance advantageously includes cavities 13 that lock both the case 11 and the cap 14 on to the stationary core 10. Several local deformations of the housing 15 can be made on the outside of the reduced diameter of the inner rib 21, so as to locally force the metal into the cavities 13 of the side plate 100 of the stationary core 10 to block said core from rotation. The local deformations are preferably trapezoidal in shape.

Thus the housing is crimped onto the stationary core.

The base of the cap 14 is provided with studs 27 intended to engage axially in the notches of the stationary core 10. In FIG. 5, the notches are the same as the cavities 13 receiving the metal forced back during the crimping of the housing 15.

After the final assembly of the contactor CT, local deformations are made of the end of the housing 15 at the cap 14, in order to create serrations 12*a* to ensure the immobilization of the cap 14 from rotation. These serrations 12*a* are advantageously received in the cavities of the cap as in FIG. 2.

This cap, by means of its base, exerts a tightening action on the side plate 100 of the stationary core 10, the cap being tilted at the cavities receiving the serrations 12*a* so that said serrations exert an axial force on the cap. The parts 17, 16, 100 and 14 are thus tightened between the end plate 115 and the serrations 12*a*. Advantageously the metal of the housing 15 is pushed into the cavities 13 after the cap is attached. Of course, this operation can also be performed before attaching the cap, the crimping of material at serrations being performed by press.

Thus, it can be seen that the local deformations penetrating into the cavities and the studs 27 make it possible to angularly index the different parts with each other.

As a result of the invention, the housing 15 does not have to be thick because of the presence of the rigidification rib 21.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. An electromagnetic contactor for an electric staffer motor, said electromagnetic contactor comprising:

connection terminals configured to connect to the battery and to the electric motor, a movable core, a main stationary core, an axial air gap provided between the movable core and the main stationary core, a tubular coil to produce a magnetic current in the air gap provided between the movable core and the main stationary core during excitation, a magnetic circuit provided with a case constructed with magnetic frame attached to the stationary core, an insulating cap enclosing the contacts of the electric power circuit and having connection terminals intended for connection to the battery and the electric motor, said case being composed of a metal bell-shaped housing, an internal ferrule made of magnetic material surrounding the coil, and a washer acting as an additional stationary core through which the movable core passes, and arranged opposite the main stationary core, wherein the metal housing of the case comprises an annular rib extending continuously opposite the cylindrical periphery of the main stationary core, said annular rib having an internal diameter respectively greater than that of the ferrule and smaller than that of the housing, so as to ensure the locking of the different parts of the case, and wherein an outer periphery of the main stationary core is in close contact with the inside periphery of an innermost internal diameter of the annular rib.

2. The contactor of claim 1, wherein serrations are made after assembly on the end of the housing to immobilize the cap from rotation.

3. The contactor of claim 1, wherein the annular rib is in contact with the free end of the internal ferrule to axially block said internal ferrule.

4. The contactor of claim 3, wherein the main stationary core comprises a side plate and wherein the inside periphery of the annular rib includes a centering portion, which serves as centerer for the side plate.

5. The contactor of claim 4, wherein the metal bell-shaped housing comprises an end plate with a central hole through which the movable core passes, wherein the annular rib comprises two sloping sides which extend on either side of the centering portion to define the annular rib with said centering portion, and wherein one of the two sloping sides is adjacent to the free end of the internal ferrule so that it presses the internal ferrule against the washer, which in turn is pressed against the end plate of the metal bell-shaped housing.

6. The contactor of claim 5, wherein the centering portion is a cylindrical portion.

7. The contactor of claim 4, wherein a thickness of the annular rib, measured in the axial direction, is less than or equal to the thickness of the side plate of the main stationary core.

8. The contactor of claim 3, wherein the metal bell-shaped housing comprises an end plate with a central hole through which the main stationary core passes, and wherein said end plate is configured to form, centrally at an inner periphery of the end plate, an axial protrusion directed in the opposite direction of the washer.

9. The contractor of claim 8, wherein a cut-off spring acts between the movable core and the metal bell-shaped housing, and wherein the axial protrusion serves as support for the other end of the spring so that said metal bell-shaped housing has an additional function.

10. An electromagnetic contactor for an electric staffer motor, said electromagnetic contactor comprising:

connection terminals configured to connect to the battery and to the electric motor;

a movable core;

a main stationary core:

an axial air gap provided between the movable core and the main stationary core;

a tubular coil to produce a magnetic current in the air gap provided between the movable core and the main stationary core during excitation;

a magnetic circuit provided with a case constructed with magnetic frame attached to the stationary core;

an insulating cap enclosing the contacts of the electric power circuit and having connection terminals intended for connection to the battery and the electric motor, said case being composed of a metal hell-shaped housing;

an internal ferrule made of magnetic material surrounding the coil; and a washer acting as an additional stationary core though which the movable core passes, and arranged opposite the main stationary core, wherein the metal housing of the case comprises an annular rib extending continuously opposite the cylindrical periphery of the main stationary core, said annular rib having an internal diameter respectively greater than that of the ferrule and smaller than that of the housing, so as to ensure the locking of the different parts of the case, wherein an outer periphery of the main stationary core is in close contact with the inside periphery of the annular rib, and wherein the annular rib ensures the locking of the different parts of the case, as well as the crimping of the housing on the stationary core-following local deformations exerted on the reduced diameter of the swaged part defining the annular rib.

11. The contactor of claim 10, wherein the main stationary core is provided with radial cavities in which serrations produced by the crimping are embedded.

12. The contactor of claim 10, wherein the cap includes at least an axial stud intended to engage in a notch of the stationary core during assembly of the cap on the end of the housing.

13. The contactor of claim 12, wherein the notch that receives the stud is the same as a cavity of the stationary core.

14. The contactor of claim 10, wherein serrations are made after assembly on the end of the housing to immobilize the cap from rotation.

15. The contactor of claim 11, wherein serrations are made after assembly on the end of the housing to immobilize the cap from rotation.

16. The contactor of claim 12, wherein serrations are made after assembly on the end of the housing to immobilize the cap from rotation.

17. The contactor of claim 13, wherein serrations are made after assembly on the end of the housing to immobilize the cap from rotation.

18. The contactor of claim 11, wherein the main stationary core comprises a side plate, and wherein the radial cavities are formed in the outer periphery of the side plate.

* * * * *